US006193307B1

(12) United States Patent
Lin

(10) Patent No.: US 6,193,307 B1
(45) Date of Patent: Feb. 27, 2001

(54) FOLDING CHAIR

(76) Inventor: Chi-Hsiang Lin, No. 40-1, Hsi-Di Liao, Shiow-Lin Tsun, Ming-Hsiung Hsiang, Chiayi Hsien (TW)

( * ) Notice: Subject to any disclaimer, the term of this patent is extended or adjusted under 35 U.S.C. 154(b) by 0 days.

(21) Appl. No.: 09/597,353

(22) Filed: Jun. 19, 2000

(51) Int. Cl.[7] ..... A47C 4/20
(52) U.S. Cl. ..... 297/58; 297/55
(58) Field of Search ..... 297/16.1, 46, 55, 297/57, 58, 463.1

(56) References Cited

U.S. PATENT DOCUMENTS 1,698,697 * 1/1929 Hageman ..... 297/58
2,877,829 * 3/1959 Ferar et al. ..... 297/55
3,058,773 * 10/1962 Panicci ..... 297/58 X
3,429,611 * 2/1969 Van Ryn ..... 297/58
4,162,806 * 7/1979 Cho ..... 297/58 X
4,298,227 * 11/1981 Berthier et al. ..... 297/58
6,095,597 * 8/2000 Huang ..... 297/58

* cited by examiner

*Primary Examiner*—Peter R. Brown
(74) *Attorney, Agent, or Firm*—Kolisch Hartwell Dickinson McCormack & Heuser

(57) ABSTRACT

A folding chair is disclosed. The folding chair has a pair of front legs each having an aperture defined therethrough. A tab is formed on an inside of each of the front legs and has a first orifice defined at an upper end thereof and aligned with the aperture. A protrusion is defined below the first orifice and a second orifice defined through the protrusion. A pair of links each have a hole defined at a first end thereof pivotally mounted on the front leg by a first pivot pin inserted through the hole, the aperture and the first orifice. A pair of rear legs are pivotally mounted with the links by a second pivot pin respectively. A seat plate pivotally mounted between the rear legs has two openings respectively defined at opposite sides thereof and is pivotally mounted on the tabs by two third pivot pins respectively inserted through the second orifices and the openings.

3 Claims, 5 Drawing Sheets

FOLDING CHAIR

BACKGROUND OF THE INVENTION

1. Field of the Invention

The present invention is related to an improved folding chair, and more particularly to a folding chair which has an reinforced strength and a stable structure.

2. Description of Related Art

A conventional folding chair, as shown in FIGS. 4 and 5, comprises a seat plate (33), a pair of front legs (31) respectively pivotally mounted at opposite sides of the seat plate (33) and a pair of rear legs (32) respectively pivotally mounted at opposite sides of the seat plate (33). The front legs (31) each have an aperture (311) defined therethrough and a first pivot pin (35) is inserted through the aperture (311) and engaged in the seat plate (33) to join the seat plate (33) and the front leg (31).

Two links (34) are respectively provided between the front legs (31) and the rear legs (32), each of which has a first end is pivotally mounted on the front leg (31) by the first pivot pin (35), and a second end is pivotally mounted on the rear leg (32) by a second pivot pin (321). The rear legs (32) each further have a recess (322) defined at a top end thereof When the chair is extended for use, a user's weight loading on the seat plate (33) is almost transmitted to the first pivot pins (35), then the apertures (311) are pressed by the first pivot pins (35) and will be expanded after the chair is used a long time. In this case, the first pivot pins (35) are no longer tightly received in the apertures (311) and there is clearance generated between the pivot pins (35) and the apertures (311), so the structure of the chair is unstable and not safe enough for the user.

Therefore, it is an objective of the invention to provide an improved folding chair to mitigate and/or obviate the aforementioned problems.

SUMMARY OF THE INVENTION

The main objective of the invention is to provide a folding chair which can retain a stable structure after being used a long time.

Other objects, advantages and novel features of the invention will become more apparent from the following detailed description when taken in conjunction with the accompanying drawings.

DETAILED DESCRIPTION OF THE PREFERRED EMBODIMENT

Figure 1:
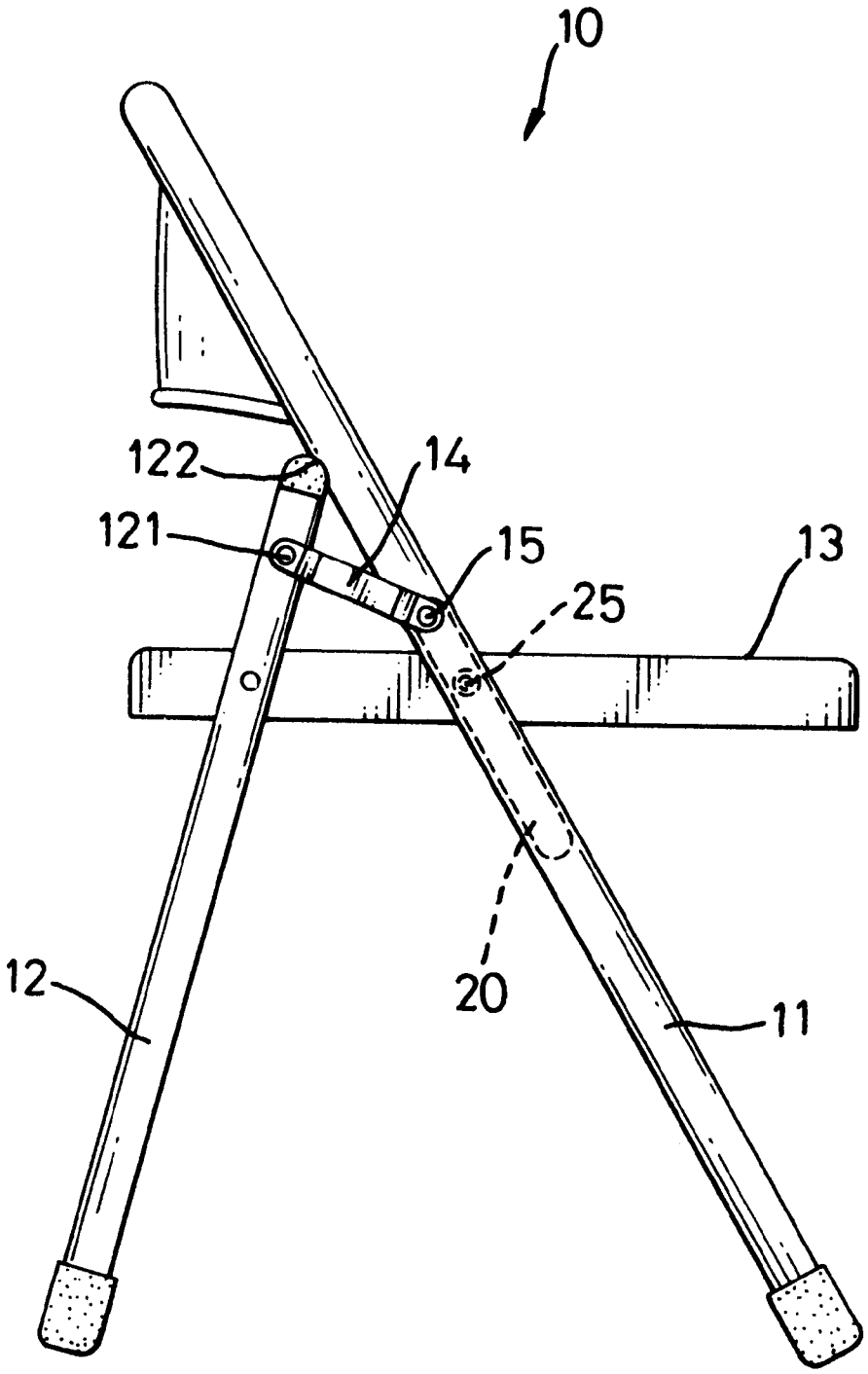
FIG. 1 is a side view of an improved folding chair in accordance with the invention.
Figure 2:
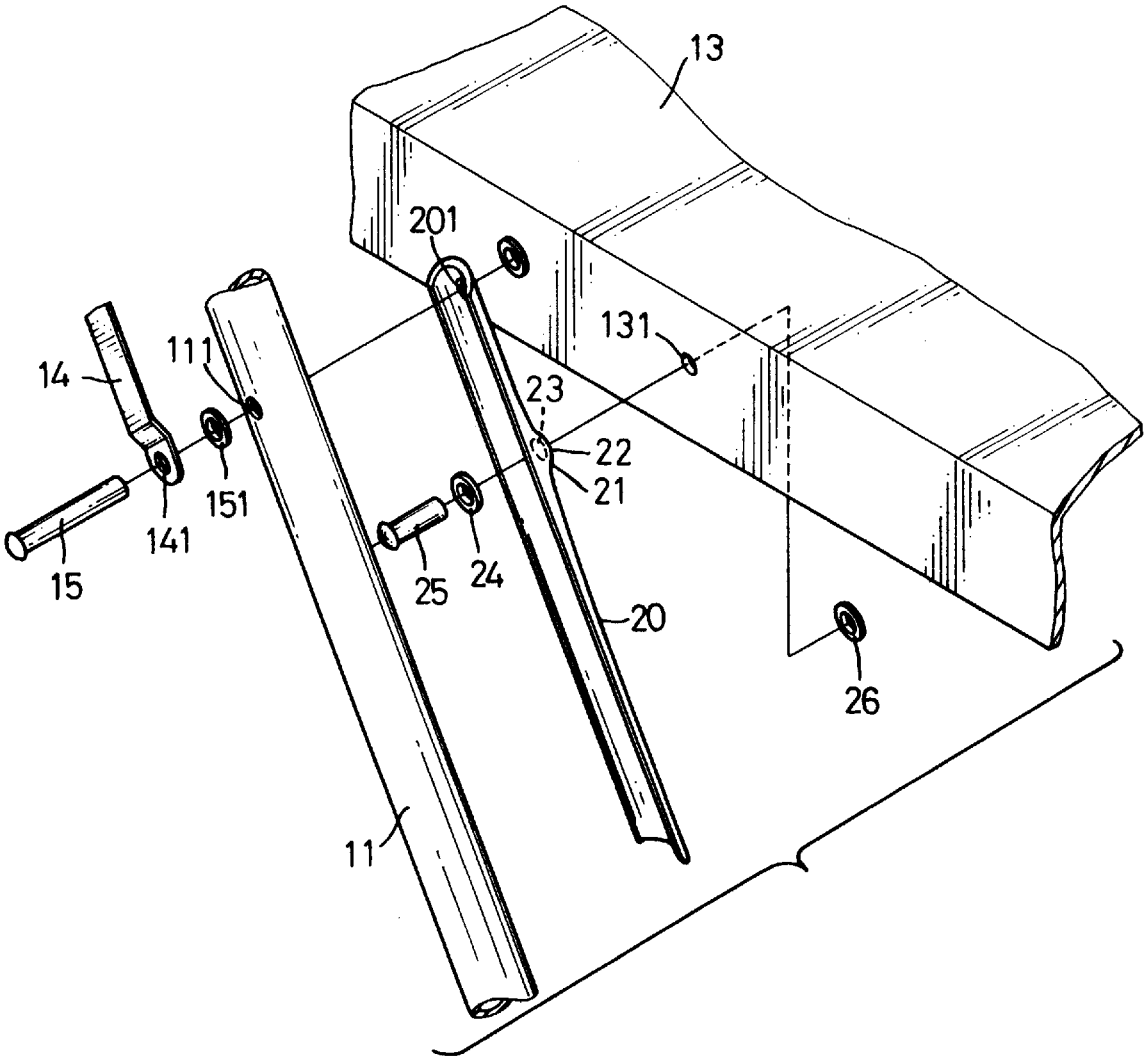
FIG. 2 is a partial exploded perspective view of the folding chair.

Referring to FIGS. 1 and 2, a folding chair (10) in accordance with the invention is composed of a seat plate (13), a pair of front legs (11) oppositely pivotally mounted at two sides of the seat (13) and a pair of rear legs (12) oppositely pivotally mounted at the two sides of the seat (13). Because the folding chair is symmetrical, only a front leg (11) and a rear leg (12) at one side is described in detail hereinafter.

The front leg (11) has a aperture (111) defined therein. A link (14) has a hole (141) defined at a first end thereof and is pivotally mounted on the front leg (11) with the first end by a first pivot pin (15) inserted through the aperture (111) and the hole (141). A first washer (151) is provided between the front leg (11) and the link (14). The link (14) is pivotally mounted on the rear leg (12) with a second end by a second pivot pin (121). The rear leg (12) comprises a recess (122) defined at a top end thereof. When the chair is extended, the front leg (11) is in contact with the recess (122) and supported by the rear legs (12).

A tab (20) which has a semi-circular cross-section is formed on an inside of the front leg (11) by welding. The tab (20) has a first orifice (201) defined at a first end thereof and aligned with the aperture (111). The first pivot pin (15) inserted through the aperture (111) is extended out of the first orifice (201). A protrusion (21) is formed in a middle portion of the tab (20) and below the first orifice (201). A second orifice (23) is defined in the protrusion (21) and in alignment with an opening (131) defined in the side of the seat plate (13). A circular plane surface (22) is formed at the top of the protrusion (21) to closely abut against the side face of the seat plate (13). A third pivot pin (25) is inserted through the second orifice (23) and the opening (131) to pivotally mount the seat plate (13) on the tab (20). A second washer (24) and a third washer (26) are respectively provided between the tab (20) and the front leg (11), and between the tab (20) and the seat plate (13).

Figure 3:
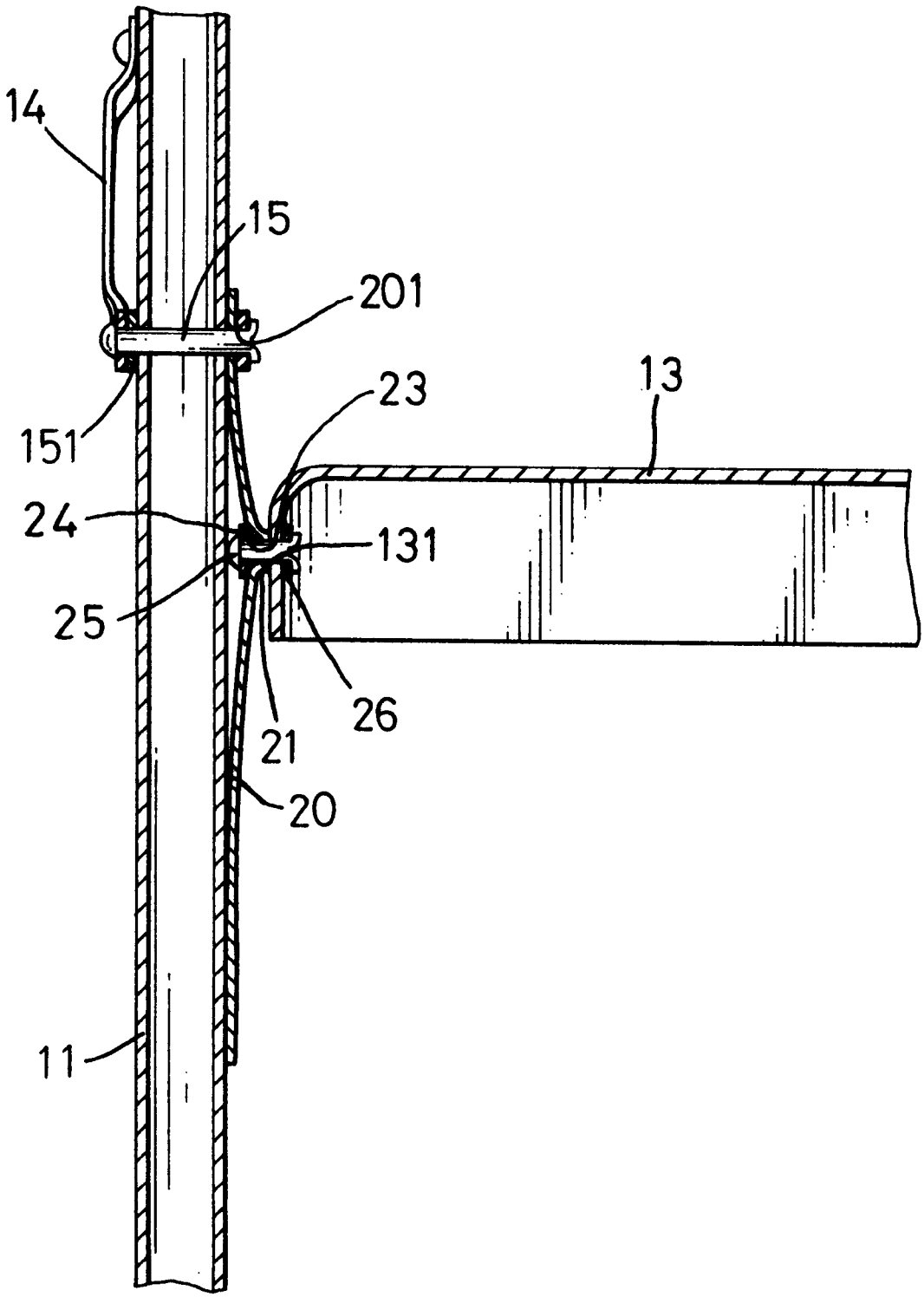
FIG. 3 is a partial sectional view of the folding chair.
Figure 4:
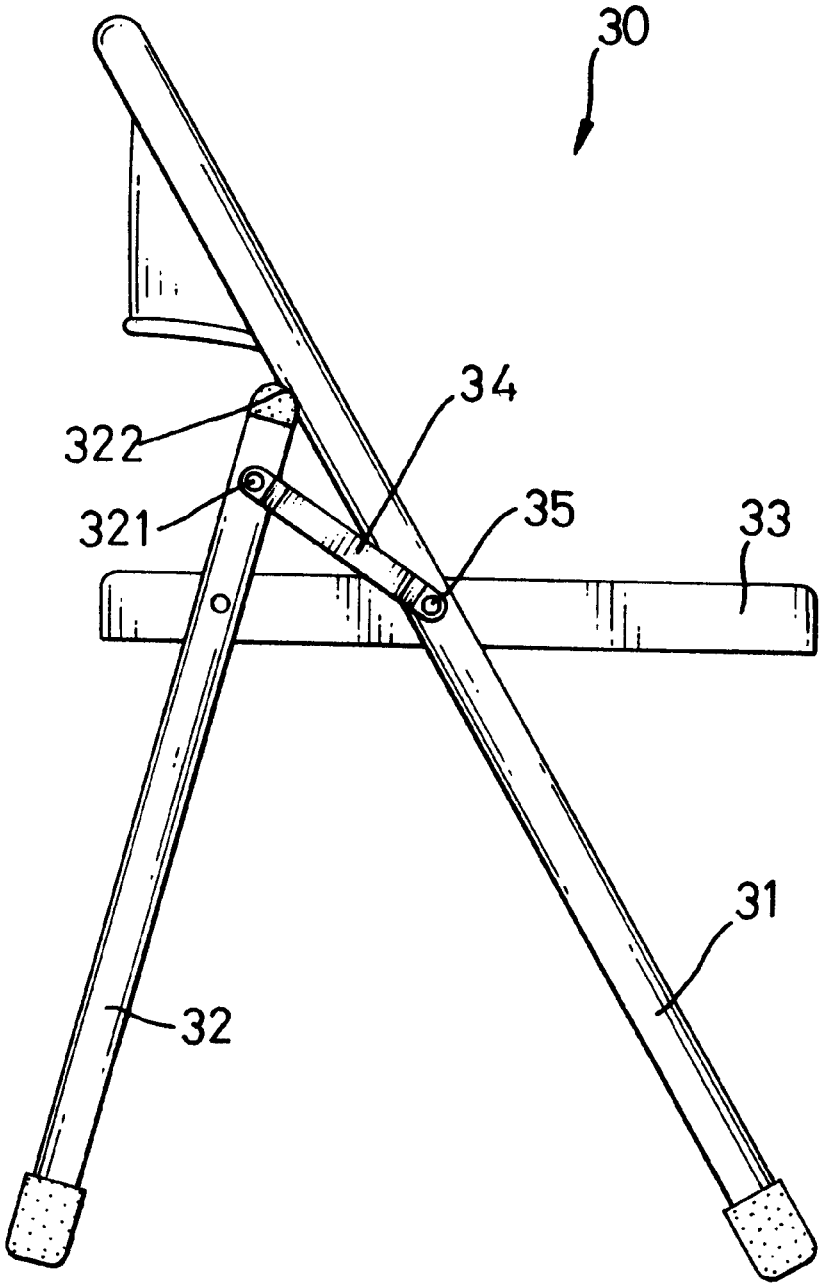
FIG.4 PRIOR ART
FIG. 4 is a side view of a conventional folding chair.
Figure 5:
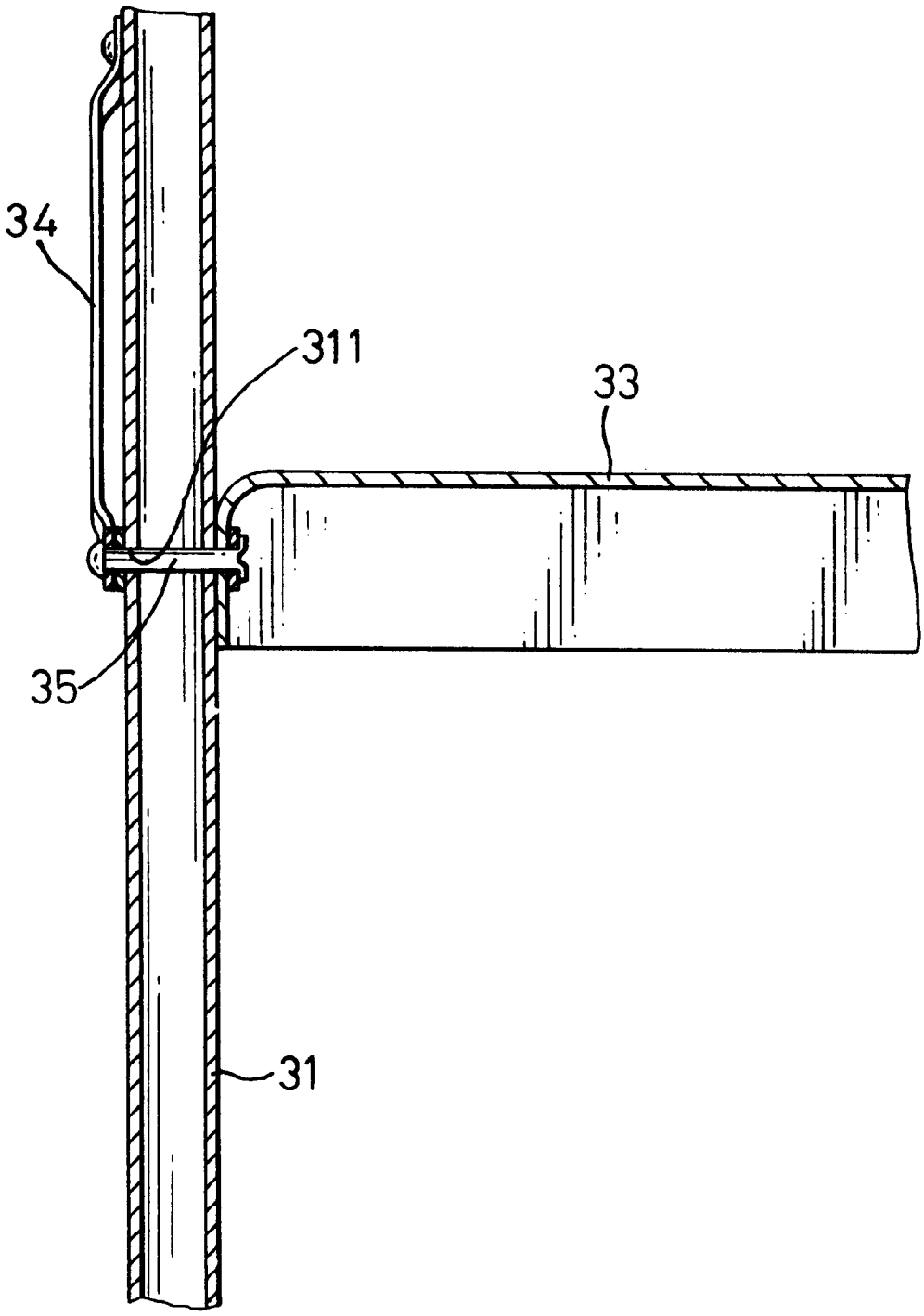
FIG.5 PRIOR ART
FIG. 5 is a partial sectional view of the conventional folding chair.

When the folding chair is extended for use, referring to FIGS. 1 and 3, a user's weight loading on the seat plate (13) is transmitted to the second pivot pin (25) in the protrusion (21). Because the second pivot pin (25) is provided on the tab (20) and the tab (20) is integrated with the front leg (11), the first pivot pin (15) is only used to connect the link (14) and the front leg (11) and has no weight loading thereon. Thus, the aperture (111) of the front leg (11) will not be expanded by the user's weight. At the same time, the weight is shared by the tab (20) and the front leg (11) and the strength of the chair is reinforced.

From the above description, it is noted that the invention has the following advantages:

1. Because the first pivot pin (15) has no weight loading thereon, the aperture (111) of the front leg (11) will not be expanded and the chair has a stable structure.
2. Because a user's weight is shared by the front leg (11) and the tab (20), the strength of the chair is reinforced.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An improved folding chair comprising:

a pair of front legs (11) each having an aperture (111) defined therethrough, and a tab (20) formed on an inside thereof and having a first orifice (201) defined at an upper end of the tab (20) and aligned with the aperture (111), a protrusion (21) defined below the first orifice (201) and a second orifice (23) defined through the protrusion (21);

a pair of links (14) each having a hole (141) defined at a first end thereof pivotally mounted on the front leg (11) by a first pivot pin (15) inserted through the hole (141), the aperture (111) and the first orifice (201);

a pair of rear legs (12) pivotally mounted with the links (14) by a second pivot pin (121) respectively;

a seat plate (13) pivotally mounted between the rear legs (12), and having two openings (131) respectively defined at opposite sides thereof and pivotally mounted on the tabs (20) by two third pivot pins (25) respectively inserted through the second orifices (23) and the openings (131).

2. The folding chair as claimed in claim 1, wherein the protrusion (21) has a circular plane surface (22) formed at a top thereof.

3. The folding chair as claimed in claim 1, wherein the rear legs (12) each have a recess (122) defined at a top end thereof.

* * * * *